US006020065A

United States Patent [19]

Girgis et al.

[11] Patent Number: 6,020,065

[45] Date of Patent: Feb. 1, 2000

[54] MULTIFILAMENT REINFORCING ARTICLES AND BINDER COMPOSITION FOR MAKING THE SAME

[75] Inventors: Mikhail M. Girgis, Wexford; Robert B. Rau, Alllison Park, both of Pa.

[73] Assignee: PPG Industries Ohio, Inc., Cleveland, Ohio

[21] Appl. No.: 08/251,546

[22] Filed: May 31, 1994

Related U.S. Application Data

[63] Continuation-in-part of application No. 07/979,506, Nov. 20, 1992, abandoned.

[51] Int. Cl.[7] ..... D02G 3/02

[52] U.S. Cl. ..... 428/378; 428/266; 428/268; 428/273; 428/375; 428/391; 428/392; 428/394; 428/395

[58] Field of Search ..... 428/378, 266, 428/268, 273, 375, 391, 392, 394, 395

[56] References Cited

U.S. PATENT DOCUMENTS

| | | | |
|---|---|---|---|
| 3,755,061 | 8/1973 | Schurb | 161/143 |
| 3,953,637 | 4/1976 | Phillips | 428/156 |
| 4,066,591 | 1/1978 | Scriven et al. | 260/29.2 |
| 4,101,706 | 7/1978 | Wolkowicz | 428/294 |
| 4,143,091 | 3/1979 | Chang et al. | 260/859 R |
| 4,208,494 | 6/1980 | Chang et al. | 525/440 |
| 4,208,495 | 6/1980 | Chang et al. | 525/440 |
| 4,309,473 | 1/1982 | Minamisawa et al. | 428/292 |
| 4,390,647 | 6/1983 | Girgis | 523/212 |
| 4,518,653 | 5/1985 | McWilliams et al. | 428/378 |
| 4,532,169 | 7/1985 | Carley | 428/109 |
| 4,549,920 | 10/1985 | Cogswell et al. | 156/181 |
| 4,578,302 | 3/1986 | Schmidt, Jr. et al. | 428/110 |
| 4,663,231 | 5/1987 | Girgis et al. | 428/378 |
| 4,762,750 | 8/1988 | Girgis et al. | 428/378 |
| 4,762,751 | 8/1988 | Girgis et al. | 428/378 |
| 4,804,509 | 2/1989 | Angell et al. | 264/136 |
| 4,880,683 | 11/1989 | Stow | 428/200 |
| 4,900,499 | 2/1990 | Mills | 264/257 |
| 5,002,823 | 3/1991 | Chen | 428/288 |

FOREIGN PATENT DOCUMENTS

| | | |
|---|---|---|
| 0316922 | 5/1989 | European Pat. Off. . |
| 1629830 | 1/1971 | Germany . |
| 1669580 | 8/1971 | Germany . |

OTHER PUBLICATIONS

The book entitled "The Manufacturing Technology of Continuous Glass Fibers" by K. L. Loewenstein, 1973, p. 29.

The brochure entitled "The Callaway Slasher", West Point Foundry and Machine Company, a Division of Batson–Cook Co.

"Acrylic Impregnant for Fibers" U.S.S.N. 07/900,034, filed Jun. 17, 1992.

"Polyurethane Coated Fibers", U.S.S.N. 07/934,133, filed Aug. 22, 1992.

K. Loewenstein, *The Manufacturing Technology of Continuous Glass Fibres*, (New York 1983), pp. 169–179.

*Primary Examiner*—Richard Weisberger
*Attorney, Agent, or Firm*—Anne Marie Cannoni

[57] ABSTRACT

The present invention provides multifilament reinforcing articles which include fibers coated and impregnated with at least a partially cured, moisture reduced residue derived from an aqueous coating composition in which the major polymeric component is an elastomeric polymer. The coated and impregnated fibers are bound with a polymeric film-forming binder in the form of a tape, wire or other shape-retaining arrangement in which the fibers are substantially parallel. In an alternative embodiment, bundles of sized fibers are bound together in a shape-retaining arrangement by an aqueous coating composition including an aqueous emulsion of a thermoplastic polymer and water in an effective amount to bind the plurality of fiber bundles together, the aqueous coating composition being free of a crosslinking material.

8 Claims, No Drawings

MULTIFILAMENT REINFORCING ARTICLES AND BINDER COMPOSITION FOR MAKING THE SAME

This application is a continuation-in-part of U.S. patent application Ser. No. 07/979,506, filed Nov. 20, 1992, abandoned.

BACKGROUND OF THE INVENTION

Many coatings and treatments for glass and other fibers have been developed over the years for use in varying applications of such fibers, for example for use with polymers where the coated fibers are incorporated into, encapsulated or surrounded by the polymer. Coatings and chemically treated fiber bundles are described in U.S. Pat. Nos. 4,663,231; 4,762,750 and 4,762,751, among others.

U.S. Pat. No. 4,900,499 discloses a process for forming a tape in a continuous thermoplastic matrix. In the process, at least one roving or strand is passed through an aqueous slurry of thermoplastic particles and consolidated in a die at a temperature of about 10° C. to about 100° C. above the softening point of the polymer.

One use for such coated fibers is as a reinforcement or support in applications requiring high tensile strength, such as in the reinforcement of fiber optic cables and storage tanks for liquids.

SUMMARY OF THE INVENTION

This invention provides multifilament reinforcing articles made from coated strands of sized fibers which are bound together in the form of tape, wire or other easily handled shapes so as to enable them to be placed easily and economically around the item to be reinforced to provide tensile reinforcement. The tensile strength of the reinforcing article is approximately the sum of the tensile strengths of the individual fibers, providing a great deal of strength in a relatively small, convenient package.

Briefly, one aspect of the present invention is a multifilament reinforcing article comprising sized fibers coated and impregnated with an at least partially cured coating composition and bound together in a substantially parallel and shape-retaining arrangement by a polymeric film-forming binder consisting essentially of a polymeric film-forming material and being free of a crosslinking material. The major polymeric component of the coating composition is an elastomeric polymer.

Another aspect of the present invention provides a multifilament reinforcing article, comprising: (a) a plurality of fiber bundles, each fiber bundle comprising a plurality of fibers having thereon a moisture-reduced residue of an aqueous sizing composition; and (b) a moisture-reduced and at least partially cured aqueous coating composition binding the plurality of fiber bundles together in a substantially parallel and shape-retaining arrangement to form a multifilament reinforcing article. The aqueous coating composition comprises an aqueous emulsion of a thermoplastic polymer and water in an effective amount to bind the plurality of fiber bundles together, the aqueous coating composition being free of a crosslinking material.

Yet another aspect of the present invention provides an aqueous binder composition consisting essentially of: (a) an aqueous emulsion of a thermoplastic material; and (b) water in an effective amount to bind a plurality of fiber bundles together, the aqueous binder composition being free of a crosslinking material. The aqueous binder composition is adapted to bind the plurality of fiber bundles together in a substantially parallel and shape-retaining arrangement to form a multifilament reinforcing article, each fiber bundle comprising a plurality of fibers having thereon a moisture-reduced residue of an aqueous sizing composition.

DETAILED DESCRIPTION OF THE INVENTION

The invention is particularly applicable to natural or synthetic textile fibers such as high modulus, low elongation fibers. Such fibers can have a modulus of elongation of at least $7\times10^6$ psi and an elongation at break of up to about 5 percent. While other fibers are suitable for use in this invention, glass fibers are the most preferred. Suitable glass fibers may be made from formulations such as D-glass, S-glass or others, although the most commonly used is E-glass. Typical formulations of suitable glass fibers are disclosed in *The Manufacturing Technology of Continuous Glass Fibres,* Library of Congress number 72-97429, by K. L. Loewenstein, Elsevier Scientific Publishing, 1973, at page 29, which is hereby incorporated by reference.

Immediately after formation, the fibers are treated with a sizing material which serves to protect them from interfilament abrasion and from abrasion by contact with guide rods and other processing apparatus. As used herein, the terms "size" or "sizing" refer to the aqueous composition applied to the fibers immediately after formation. The term "coating" refers to the aqueous composition applied secondarily, after the sizing. The term "binder" refers to the chemical added to the coated strands just before they are fed into a die or calendaring machine to be made into tape, wire, or the like. The coating and binder are preferably the same composition or may alternatively be different compositions applied sequentially to the bundles of fibers.

While the many sizes known in the art may be used on the fibers to be employed in this invention, non-starch sizes are preferred. The aqueous sizing composition usually comprises a hydrophilic reducing agent such as a coupling agent and a protectant which can be a glass fiber lubricant or a glass fiber film former. The aqueous sizing composition can also include silane coupling agents, lubricants, antifoams, antistatic agents, emulsifiers, bactericides or any other ingredient(s) known in the art to be useful in sizing fibers, in addition to water.

Non-limiting examples of suitable sizing compositions and the manner of application of the sizing composition and coating to the sized glass fibers, as well as the types of fibers used, can be found in U.S. Pat. Nos. 4,663,231; 4,762,750 and 4,762,751, which are hereby incorporated by reference in their entireties. An example of a suitable non-starch sizing is disclosed in U.S. Pat. No. 4,390,647, which is also hereby incorporated by reference in its entirety.

The aqueous sizing composition is commonly applied by sprayers, rollers, belts, or the like. Suitable applicators are discussed in Loewenstein at pages 169–177, which are hereby incorporated by reference. The sized glass fibers generally have between about 0.05 and 5 percent of sizing composition based on the weight of the glass fiber.

A plurality of fibers are gathered into a plurality of bundles by gathering shoes, a comb or any other gathering device well known to those of ordinary skill in the art. Suitable gathering devices are discussed in Loewenstein at pages 178–179, which are hereby incorporated by reference.

The sized glass fibers may be gathered into bundles comprising a plurality of individual fibers, generally from 200 to more than 3000. The bundles are usually wound onto a forming package and the sizing is dried at room temperature or by oven heating prior to coating.

The multifilament reinforcing articles of the present invention are provided by processing the sized and then coated bundles of fibers to form an elongated, substantially shape-retaining configuration, such as a tape, wire, cable or other suitable shape, by using a binder to hold the fibers in the desired shape. Any method known to those skilled in the art can be used to form such articles, for example, processing a plurality of coated glass fiber strands with a binder between calendaring rollers or in a suitable die.

The term "tape" as used herein means a predominantly non-metallic, relatively narrow fabric or flexible strip or band. The term "wire" as used herein means a predominantly non-metallic, relatively rounded and flexible, thread, slender rod or cable. Neither definition requires that the article be adhesive or restrict it from so being.

As presently preferred, the sized fibers for use in the present invention are coated with an aqueous coating or binder composition which comprises an aqueous emulsion of a thermoplastic material and water in an effective amount to bind the plurality of fiber bundles together, the aqueous coating composition being free of a crosslinking material. The binder composition binds the plurality of fiber bundles together in a substantially parallel and shape-retaining arrangement to form a multifilament reinforcing article.

Any suitable emulsifiable thermoplastic material can be used in the aqueous binder composition of the present invention. The thermoplastic material may be internally emulsified, i.e., the thermoplastic material includes in its structure functional groups which facilitate emulsification of the thermoplastic material in an aqueous medium. Alternatively, the thermoplastic material may be emulsified externally by including an additional compound or material which functions as an emulsifier. Preferably the thermoplastic material is the same or similar to that of the material which is to be reinforced. Non-limiting examples of suitable thermoplastic materials include emulsifiable polyesters, urethanes, polycarbonates, polyolefins, vinyl alcohols, vinyl chlorides, vinyl acetates, acrylics, amides, imides, acetals, polysulfones and polyphenylene oxide and copolymers and/or mixtures thereof.

As presently preferred, the thermoplastic material is selected from the group consisting of an emulsifiable polyester, ethylene-acrylic acid copolymer, acrylic polymer, polyurethane, polyolefin, poly(vinyl alcohol), poly(vinyl chloride), poly(vinyl acetate), ethylene-vinyl acetate copolymer and mixtures thereof. Alternatively, the thermoplastic material is selected from the group consisting of an emulsifiable polyester, polyolefin, poly(vinyl alcohol), poly(vinyl chloride), poly(vinyl acetate), ethylene-vinyl acetate copolymer and mixtures thereof.

Suitable polyesters for use in the present invention are emulsifiable polycondensation products of dicarboxylic acids with dihydroxy alcohols, such as polyethylene terephthalates and polybutylene terephthalates. Non-limiting examples of suitable polyolefins include emulsifiable polypropylene, polyethylene, polybutenes, polyisoprenes and interpolymers of ethylene with one or more polar comonomers, such as are set forth in U.S. Pat. Nos. 4,663,231 and 4,762,750.

Suitable urethanes for use in the binder composition include any emulsifiable thermoplastic urethane, such as elastomeric curable polyurethane or polyurethane-urea type polymers. Non-limiting examples of suitable aqueous emulsions of polyurethane polymers are discussed in U.S. Pat. Nos. 4,066,591; 4,143,091; 4,208,494; 4,208,495; 4,762,750, 4,762,751 and U.S. patent application Ser. No. 07/934,133, each of which is hereby incorporated by reference in its entirety. The preferred aqueous emulsion of polyurethane is Witcobond® W-290H, which is commercially available from Witco Chemical Corporation. Witcobond® W-290H is milky white in appearance, aliphatic in type with a 65 percent solids level and with a particle size of around 5 microns, a pH at 25° C. (77° F.) of 7.5, a viscosity as measured by Brookfield LVF in cps of 200 and surface tension of 42 dynes/cm and is believed to be internally emulsified. Other useful aqueous emulsions of polyurethane include Rucothane emulsions, which are commercially available from Ruco Polymer Corporation of Hicksville, N.Y.

Non-limiting examples of suitable acrylic polymers include emulsifiable acrylic homopolymers and copolymers, such as acrylonitriles, acrylamides, and ethylene-acrylic acid copolymers. Mixtures of an emulsifiable self-crosslinkable acrylic and an emulsifiable crosslinkable ethylene-acrylic acid copolymer preferably include greater than about 30 weight percent of the emulsifiable crosslinkable ethylene-acrylic acid copolymer.

Examples of self-crosslinking acrylic emulsions are discussed in U.S. patent application Ser. No. 07/900,034 which is hereby incorporated by reference in its entirety. Rhoplex® emulsions, which are commercially available from the Rohm & Haas Company, are useful in this invention. A specific example is Rhoplex® TR-407 which is anionic and has a T300 of +30, is milky white in appearance, has 45.5 percent solids, a Brookfield LVF viscosity at 25° C. of 30 cps (#1 spindle, 60 RPM), a pH of 3.5, and a density of 8.9 lb/gal. Another example is Rhoplex® HA-8 which is nonionic, has a T300 of −14, is milky white in appearance, has 45.5 percent solids, a Brookfield LVF viscosity of 550 cps (#3 spindle, 60 RPM), a pH of 3.0, and a density of 8.7 lb/gal.

Suitable ethylene-acrylic acid (EAA) copolymers include copolymers having a molecular weight of about from 5,000 to 10,000, a hardness (Shore D) of from about 42 to 48, a vicat softening point of about 104 to 115, a melt index of from about 300 to 1300 g/10 min. and a density of about 0.96 gm/cc at 25° C., such as are described in U.S. patent application Ser. No. 07/900,034. Specific examples of such copolymer dispersions are Michem® Prime 4990 or Michem® Prime 4983HS available from Michelman Inc. of Cincinnati, Ohio, which are white in color and have a total solids content of approximately 20 to 38 percent, a Brookfield viscosity of about 100 to 600, and a surface tension of about 44 to 49 dynes/cm, and weigh about 8.22 lbs/gal. The dispersible polymer in the two Michem® Prime formulations are Primacor® 5990 and 5980, respectively.

Non-limiting examples of emulsifiable ethylene vinyl acetate copolymers which are useful in the present invention are described in U.S. Pat. No. 4,663,231. Suitable emulsifiable ethylene-vinyl acetate copolymers are commercially available from Air Products and Chemicals, Inc. in an emulsion form under the Airflex® trade designation. A preferred vinyl acetate/ethylene copolymer emulsion is Airflex® 410.

Suitable polyvinyl alcohols, such as ethylene vinyl alcohol or propylene vinyl alcohol, are commercially available from Air Products.

Preferably, the thermoplastic polymer comprises at least about 70 weight percent, and more preferably about 80 weight percent of the aqueous coating composition on a non-aqueous or solids basis.

The aqueous emulsion of the thermoplastic polymer can also comprise an external emulsifying agent for emulsifying the thermoplastic polymer. Suitable emulsifying agents include nonionic or anionic emulsifiers including polyoxyalkylene block copolymers such as a polyoxypropylene-polyoxyethylene copolymer (Pluronic™ F-108 available from BASF Corporation of Parsippany, N.J.), ethoxylated alkyl phenols such as ethoxylated octylphenoxyethanol (IGEPAL CA-630 available from GAF Corporation of Wayne, N.J.), polyoxyethylated vegetable oils (such as EMULPHOR EL-719 available from GAF), and polyoxyethylene sorbitan esters such as polyoxyethylene sorbitan monooleate (TWEEN® available from ICI Americas Inc. of Wilmington, Del.). One of ordinary skill in the art would understand that the aqueous emulsion of the thermoplastic polymer may alternatively be internally emulsified.

Preferably, the emulsifying agent comprises between about 0.5 weight percent to about 5 weight percent of the aqueous coating composition on a non-aqueous or solids basis.

The binder composition can also include additives such as plasticizers, waxes, flame retardants, dyes and other additives well known to those of ordinary skill in the art. Preferably, the aqueous coating composition is free of plasticizers and/or waxes. Non-limiting examples of suitable additives are set forth in U.S. Pat. No. 4,762,750.

The plasticizer can comprise up to about 30 weight percent of the binder composition on a non-aqueous or solids basis and more preferably comprises about 10 to about 20 weight percent of the binder composition. Non-limiting examples of suitable plasticizers and waxes are set forth in U.S. Pat. No. 4,762,750. Such plasticizers can include butyl benzyl phthalate (such as Sanitizer 160, which is commercially available from Monsanto), trixylylphosphate (such as Phosflex® 179-A, which is commercially available from Stauffer Chemical Company), dibenzoate esters of dipropylene glycol (such as Benzoflex), and polyethylene glycols (such as are available from Velsicol Chemical Corporation).

The wax(es) can comprise up to about 10 weight percent of the binder composition on a non-aqueous or solids basis and more preferably comprises about 3 to about 5 weight percent of the binder composition. Non-exclusive examples of suitable waxes are aqueous emulsifiable or dispersible waxes including microcrystalline waxes such as Polymekon SPPW-40, which is commercially available from Petrolite Corporation—Bareco Division of Tulsa, Okla., and Mobilcer Q, which is commercially available from Mobil Chemical Company. Such waxes may also include emulsifiers and/or dispersants.

The flame retardant(s), such as an aqueous dispersion of a brominated epoxy polymer, and dye(s) can comprise up to about 10 weight percent of the binder composition on a non-aqueous basis. More preferably, the flame retardant comprises about 5 to about 10 weight percent and the dye about 1 to about 10 weight percent of the binder composition.

The binder composition is free of any self-crosslinking material or any material which is crosslinkable with the thermoplastic polymer. Non-exclusive examples of crosslinking materials include aldehyde condensates used in conjunction with acid or basic catalysts, such as melamine formaldehyde (such as Resimene 841, which is commercially available from Monsanto Company), hexakis (methoxymethyl) malemine, phenol formaldehyde, resorcinol formaldehyde and lower hydrocarbon epoxides (such as Witcobond® XW aqueous epoxy emulsion, which is commercially available from Witco). Further examples of such crosslinking materials are set forth in U.S. Pat. Nos. 4,066,591, 4,762,750 and 4,762,751.

The aqueous portion of the binder composition includes volatile liquids, such as water, and non-volatile liquids. The amount of water results in a total solids concentration and viscosity for the binder composition that enables the composition to coat a majority of the bundles of fibers and provide adhesion between the bundles. Preferably the total solids concentration is greater than about 40 weight percent, and more preferably about 50 to about 60 weight percent.

The amount of the coating on the strand is defined as the dip pick-up or DPU, which is the coated strand weight minus the uncoated strand weight, then divided by the uncoated strand weight. Multiplying the resultant figure by 100 results in %DPU. The DPU of the coated bundles is preferably about in a range of about 5 to about 40% for a single pass through the coating bath and drying step. The strands may ultimately have a greater amount of coating than 40% by passing them through the bath a number of times.

The aqueous binder compositions used to coat and bind the bundles may be prepared by adding the components to the appropriate amount of water with any emulsifiers or other suitable additives such as flame retardants, dye or wax. The bundle of fibers is coated, for example, by dipping in a bath, or other conventional methods such as those described in U.S. Pat. 4,663,231, which is hereby incorporated by reference in its entirety.

The coated bundles are consolidated and shaped to form a multifilament reinforcing article. The coated bundles can be consolidated by applying pressure to the bundles by using a pressure applicator, for example, by passing the bundles through a consolidating die or between nip rollers. The pressure applied to the bundles depends upon such factors as the desired configuration of the article, the number of bundles and diameter of each bundle, to name a few. The consolidating die is preferably unheated, although the die can be heated if desired. Preferably the temperature of the bundles as they pass through the pressure applicator and speed at which the bundles pass through the pressure applicator do not cause the thermoplastic material to appreciably soften or melt.

The consolidated article can be further shaped or dried by heating in a furnace, oven or between calendaring rolls and optionally passing the article through a shaping die or flat grooved pulley. Preferably, the drying is conducted at a temperature in the range of about 400° F. to 600° F. (204° C. to 315° C.) for a time of about 10 to about 60 seconds or any equivalent time/temperature relationship to accomplish a similar degree of moisture reduction. The article is configured such that the bundles are bound together in a substantially parallel and shape-retaining arrangement.

In an alternative embodiment, the sized fibers are coated and impregnated with an aqueous coating composition and subsequently bound together with a polymeric film-forming binder consisting essentially of a polymeric film-forming material. The impregnating composition contains, as the major polymeric component, one or more elastomeric polymers which is at least partially cured.

The impregnating or coating composition can be different from the binder composition in terms of, for example, the particular components or the amount of any component. For example, the coating composition may have additional or less components or different amounts of any given component.

Among the elastomeric polymers useful in the aforesaid coating composition are polyurethanes, silicones, fluororubbers, polysulfide polymers, polyethers, interpolymers of ethylene with one or more polar comonomers and acrylic polymers. The compositions are made at least partially curable by inclusion of functional groups in at least one of the elastomeric polymers present which makes that polymer self-crosslinking as is the case when a polyurethane or an ethylene-acrylic acid copolymer is used. Alternatively, there may be included in the composition a separate crosslinking agent such as a melamine formaldehyde or phenol formaldehyde resin, or an epoxy resin. The composition may also include optional components such as a plasticizer, microcrystalline wax, etc.

Examples of such coating compositions are described in U.S. Pat. Nos. 4,663,231; 4,762,750 and 4,762,751, and U.S. patent application Ser. Nos. 07/900,034, filed Jun. 17, 1992 and 07/934,133, filed Aug. 21, 1992. These coatings are all aqueous when applied, i.e., have components which are water dispersible, soluble or emulsifiable.

The preferred compositions for use in the invention include compositions comprising:

(a) Interpolymers of ethylene with one or more polar comonomers, along with crosslinking resinous material and a diene-containing elastomer in an amount sufficient to effect partial curing of the coating. Such compositions and specific examples of the aforesaid components are described in U.S. Pat. No. 4,663,231.

(b) Coating compositions containing an elastomeric polymer such as an ethylene-containing interpolymer or a polyurethane as described in U.S. Pat. No. 4,762,750. The coating further has a crosslinking material which may be self crosslinkable or crosslinkable with the polymer.

(c) Compositions described in U.S. Pat. No. 4,762,751 which comprise a polyurethane and a non-sulfur vulcanizing crosslinking material. The polyurethane may be internally softened, internally plasticized or unplasticized and unsoftened. When the polyurethane is unsoftened or unplasticized, a softening agent is used.

(d) Compositions described in U.S. patent application Ser. No. 07/900,034 above which are aqueous coating compositions containing a self-crosslinking acrylic polymer and a crosslinkable ethylene-acrylic acid copolymer which are present in ranges of between about 30 and 90 weight percent and about 5 and 30 weight percent respectively, before dilution with water. The amount of water in the composition is an amount to provide the composition with between 10 and 50 percent solids before drying. The coating may also include an elastomeric curable polymer such as a polyurethane. The coating may also include a microcrystalline wax which may be oxidized and/or a water soluble dye in an amount sufficient to impart a color to the residue on the fibers.

The predominant component, besides water, is the acrylic polymer emulsion of acrylic homopolymers and copolymers including copolymers with acrylamide and methylol acrylamide. The acrylic emulsion is preferably of the self-crosslinking type and preferably anionic or non-ionic. Although the acrylic emulsion is self-crosslinking, if a faster crosslinking rate is desired or less than optimal conditions exist, a catalyst may be added to speed the reaction rate. The reactive acrylic monomers include acrylamide and methylol acrylamide which crosslink upon the addition of heat to yield the acrylic polymer and water. The acrylic is characterized by the temperature at which the torsional modulus of an air dried film is 300 kg/cm$^2$, referred to as T300, and which is a relative measure of stiffness. A T300 of about 22° C. is considered soft while higher numbers indicate more stiff acrylics. The acrylics which may be used in the practice of this invention have a T300 which may range from about −50 to about +35. The use of a low T300 acrylic will result in a relatively less stiff product which may also be somewhat tacky. The addition of a polyurethane can reduce this tackiness yet also detracts from stiffness. Preferred acrylic emulsions include the Rhoplex emulsions discussed above. Preferred ethylene-acrylic acid copolymers include the Michem Prime® copolymers discussed above.

(e) Aqueous compositions containing at least one polyurethane and at least 15 weight percent on a non-aqueous basis of one or more high boiling point plasticizers as described in U.S. patent application Ser. No. 07/934,133. The polyurethane component is an elastomeric curable polyurethane or polyurethane-urea type polymer. These materials generally have a glass transition temperature of around 0° C. or less. Suitable polyurethane polymers are described in U.S. Pat. Nos. 4,143,091; 4,208,494; 4,208,495; 4,066,591 and 4,762,751. The preferred polyurethane is that sold as Witcobond® W-290H. The film properties of the 290H material, when cured with 6.5 parts of a crosslinking epoxy resin dispersion like Witcobond® XW for 100 parts of urethane latex, are: 4500 psi tensile strength, 720 percent elongation and moduli of 250 psi at 100%, 540 psi at 300% and 1550 psi at 500%. The amount of polyurethane can range from about 45 to about 80 weight percent of the non-aqueous portion of the impregnating coating composition.

Also present in these aqueous coating composition is a plasticizer having a sufficiently high boiling point such that it will not become volatile during the impregnation of the bundles of fiber, e.g., plasticizers with boiling points above 225° C. (437° F.) at a pressure of 10 millimeters of mercury (mm Hg). Examples of such plasticizers are Santicizer® 160 which is a clear oily liquid having a boiling point of 240° C. (464° F.) at 10 mm Hg a specific gravity of 1.12, diisononyl phthalate (DINP) (sold as PX-109 by Aristech Chemical Corporation), and the mixed hexyl, octyl and decyl ester of 1,2,4-Benzenetricarboxylic acid sold as PX-336 by Aristech Chemical Corp.

The binder which holds the coated glass fiber strands together as a reinforcing article such as tape or wire is a polymeric film-forming material. Preferably, the polymeric film-forming material is a thermoplastic material. Preferred polymeric film-forming materials include an epoxy resin, polyester, ethylene-acrylic acid copolymer, acrylic polymer, polyurethane, polyolefin, poly(vinyl alcohol), poly(vinyl chloride), poly(vinyl acetate), ethylene-vinyl acetate copolymer or any other polymeric film-forming material known in the art which is compatible with the ingredients of the particular coating used.

The choice of binder is usually dictated by the composition of the coating, i.e., the binder must be compatible with the coating. If a strand coated predominately with polyurethane is to be used, for example, the binder is preferably a polyurethane and in most cases the same or a similar polyurethane can be employed.

Preferably the binder is free of a crosslinking material. Also, the polymeric film-forming material preferably comprises at least about 70 weight percent, and more preferably at least about 80 weight percent of the binder on a non-aqueous basis. The binder may be aqueous but is not required to be so.

The various polyurethanes described above can be utilized and the preferred polyurethane for use as the binder is that sold as Witcobond® W-290H, also described above. Among the other polymeric film-forming binder materials for use in making the reinforcing article are ethylene vinyl acetate copolymers described in U.S. Pat. No. 4,663,231. A suitable ethylene-vinyl acetate copolymer is Airflex® 410 vinyl acetate/ethylene copolymer emulsion. Ethylene-acrylic acid copolymers and other acrylic polymers also have been described above and may be employed as the binder.

The bundles of fibers may be impregnated by passing the fibers through a bath containing the impregnating composition and bound together by passing the bundles through a bath containing the binder. If the impregnant and binder are the same composition, a single bath may be used to both impregnate and bind the bundles. The strand may be "opened up" just before entering the secondary treating composition bath by passing it over a bar or other spreading device which acts to separate the individual fibers from one another. This spreading of the fibers from one another results in a more thorough impregnation of the strand with the coating.

The coated fibers may be made into a tape by any method known to those skilled in the art, such as that shown in U.S. Pat. No. 3,755,061, which is hereby incorporated by reference in its entirety or by any of the methods discussed above. One method is, for example, to combine a plurality of sized, coated glass fiber strands between calendaring rollers with the addition of the binder. This may be done, for example, at a temperature of about 350° F. to 600° F. (177° C. to 315° C.). The time for the binder and strands to be between the rollers is short. What is required is a contact time at the temperature such that the binder cures to some degree in contact with the strands. The strands and binder can be further cured by heat treating if desired.

Another method of producing tape intended to be encompassed by this invention is to combine the sized glass fibers with the coating and then feed the coated, sized glass fibers immediately into the calendaring rollers. By going directly from the step of coating the fibers to producing tape, storage of coated fibers and any possible damage to the coated fibers in winding, transport, and storage can be eliminated. In this method, either a binder is added directly to the coating bath, or an excess of one of the regular coating components which meets the above definition of a binder is added to the coating bath.

The coated fibers may be made into the shape of wire in a similar way but instead of calendaring rollers the strands are brought together through a die of the desired diameter where they are coated with binder. The strands then pass through an oven at the above temperature and then through yet another die while still hot. The wire configuration is considerably stiffer than the tape configuration.

Other configurations can be used so long as they are sufficiently shape-retaining to provide bound fibers in a substantially parallel arrangement and permit easy handling compared to flexible bundles of filaments.

The tape, wire or other shaped article made in accordance with the invention may be used to reinforce objects by applying it to the object. A tape configuration may be placed around, for example, a fiber optic cable, either by bending it around the cable with the seam on one side or by bending it around the cable in a spiral or helix configuration. The wire configuration may be wound around the outside of objects to be reinforced, for example, storage tanks for liquids. The wire, tape or other configuration makes the fibers easy to handle and allows rapid application to the object to be reinforced.

The following is an example of the practice of the alternative embodiment of the present invention: glass fibers were produced and sized with an aqueous sizing in which the non-volatile portion contained 48 parts by weight of a polyoxyalkylene polyol available under the trade designation Pluracol® V-10, 9.1 parts by weight of a silane coupling agent available under the trade designation A-1108 from the Union Carbide Corporation, and 4.5 parts by weight of a polyamine lubricant commercially available under the trade designation Emery® 6717, which had been treated with acetic acid. An alternative sizing is shown in U.S. Pat. No. 4,762,751 at column 16, lines 19–48.

The sized fibers were dipped into an aqueous coating bath and dried in order to coat them. The coating bath contained polyurethane polymer (Witco W-290H), butyl benzyl phthalate (Sanitizer 160), polyoxyethylene sorbitan monolaurate (Tween 21), aqueous dispersion of polyurethane polymer (Baybond XW 110), aqueous epoxy dispersion (Witco XW), the composition and preparation of which are described in U.S. Pat. No. 4,762,751 at column 16, line 60 to column 17 line 8, except that about 138 grams of a microcrystalline wax (Polymekon SPPW-40 microcrystalline wax, which is a hydrocarbon water dispersion with a 40 percent solids) was added.

The impregnated coated fiber bundles were passed through an oven to reduce the moisture content and cure the impregnating coating. The temperature of the oven was in the range of about 490° F. (254° C.) to 530° F. (277° C.) and the line speed was around 200 to 250 feet per minute (60 to 76 meters/min) through the oven.

The coated fibers were made into a tape configuration by feeding the coated, dried fiber strands into a bath of Witcobond® 290-H polyurethane binder in a simple dip arrangement. The strands were separated from each other in the bath in order to provide more complete wet out. The strands were guided together to form a 0.75 inch (19 mm) wide band. The binder covered strands next entered a thermal calendaring machine which was held at a temperature of about 480° F. (249° C.). The heated contact drum dried and cured the binder to form a finished tape which was produced at a speed of about 18 feet per minute. The tape released cleanly from the Teflon® coated calendar belt and drum and did not require the use of a release paper. The tape was air cooled and then wound on spools. The final product was 0.75 inches (19 mm) wide by 0.02 inches (0.5 mm) thick, though tape of other dimensions may of course be produced. The tape exhibited excellent tensile strength, and was easily applied to optical cables as reinforcement.

An alternative means of producing tape is by using a commercially available slashing (coating) machine such as the Callaway Slasher Model 51 produced by the West Point Foundry and Machine Company of West Point, Ga. This machine can coat the strands and align them before winding them around four 18 inch (45.7 cm) diameter heated drums, giving a contact time between the tape and drum of about 15 seconds per drum. The first two drums are Teflon® coated and the second two are stainless steel. The tape travels approximately ¾ of the way around each drum sequentially in a manner such that both sides of the tape contact a drum, and it is then wound on a spool.

The bundles or strands of the multifilament reinforcing articles of the present invention exhibit good adhesion between the strands to provide strong reinforcement or support in applications requiring high tensile strength, such as in the reinforcement of fiber optic cables and storage tanks for liquids. Also, the coating or binder on the strands can be selected to be compatible with the matrix polymer to be reinforced to provide enhanced strength and wear.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, we claim:

1. A multifilament reinforcing tape, comprising:

(a) a plurality of fiber bundles, each fiber bundle comprising a plurality of fibers having thereon a moisture-reduced residue of an aqueous sizing composition; and (b) a moisture-reduced and at least partially cured aqueous coating composition adapted to bind the plurality of fiber bundles together in a substantially parallel and shape-retaining arrangement to form a multifilament reinforcing tape, the aqueous coating composition comprising an aqueous emulsion of a thermoplastic material and water in an effective amount to bind the plurality of fiber bundles together, the aqueous coating composition being free of a crosslinking material.

2. The multifilament reinforcing article according to claim 1, wherein the thermoplastic material of the coating composition is selected from the group consisting of a polyester, ethylene-acrylic acid copolymer, acrylic polymer, polyurethane, polyolefin, poly(vinyl alcohol), poly(vinyl chloride), poly(vinyl acetate), ethylene-vinyl acetate copolymer and mixtures thereof.

3. The multifilament reinforcing article according to claim 1, wherein the thermoplastic material of the coating composition is selected from the group consisting of a polyester, polyolefin, poly(vinyl alcohol), poly(vinyl chloride), poly (vinyl acetate), ethylene-vinyl acetate copolymer and mixtures thereof.

4. The multifilament reinforcing article according to claim 1, wherein the aqueous emulsion of the thermoplastic material comprises an emulsifying agent for emulsifying the thermoplastic material.

5. The multifilament reinforcing article according to claim 1, wherein the aqueous coating composition is free of a plasticizer.

6. The multifilament reinforcing article according to claim 1, wherein the aqueous coating composition is free of a wax.

7. The multifilament reinforcing article according to claim 1, wherein the thermoplastic material comprises at least about 70 weight percent of the aqueous coating composition on a non-aqueous basis.

8. The multifilament reinforcing article according to claim 1, wherein the thermoplastic material comprises at least about 80 weight percent of the aqueous coating composition on a non-aqueous basis.

* * * * *